US005806848A

United States Patent [19]

Edward

[11] Patent Number: 5,806,848

[45] Date of Patent: Sep. 15, 1998

[54] APPARATUS FOR DETERMINING A SPEED OF A PROJECTILE

[76] Inventor: Bruce Douglas Edward, #16, 51028 Range Road 261, Spruce Grove, Alberta, Canada, T7Y 1B9

[21] Appl. No.: 681,373

[22] Filed: Jul. 23, 1996

[51] Int. Cl.[6] ..... F41J 5/06

[52] U.S. Cl. ..... 273/372; 473/190; 473/192

[58] Field of Search ..... 273/372; 473/155, 473/157, 190, 192, 478, 480; 73/504.01, 167

[56] References Cited

U.S. PATENT DOCUMENTS 3,091,466 5/1963 Speiser ..... 473/155
3,643,959 2/1972 Cornell et al. ..... 273/176 FA
4,807,887 2/1989 DeVale et al. ..... 273/372
5,447,315 9/1995 Perkins ..... 273/371
5,478,077 12/1995 Miyahara ..... 273/372 X

*Primary Examiner*—Jessica Harrison
*Assistant Examiner*—Michael O'Neill
*Attorney, Agent, or Firm*—Davis and Bujold

[57] ABSTRACT

An apparatus for determining a speed of a projectile uses control logic and a single acoustic sensor connected to the control logic. The control logic includes a pulsing clock. The control logic starts the clock upon receiving a first signal from the acoustic sensor and stops the clock upon receiving a second signal from the acoustic sensor. The control logic converts pulses of the clock into a numeric value indicative of speed based upon a preprogrammed distance measurement setting. The numeric value can then be converted into miles per hour and displayed to the user.

10 Claims, 7 Drawing Sheets

FIG. 1
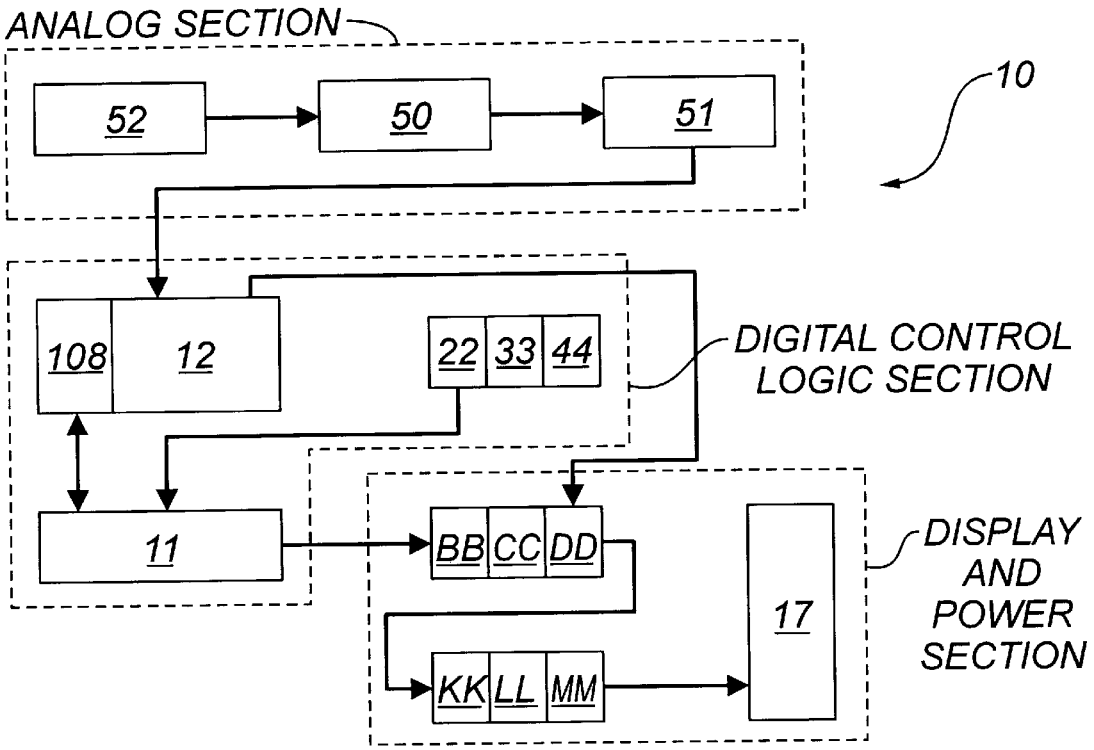
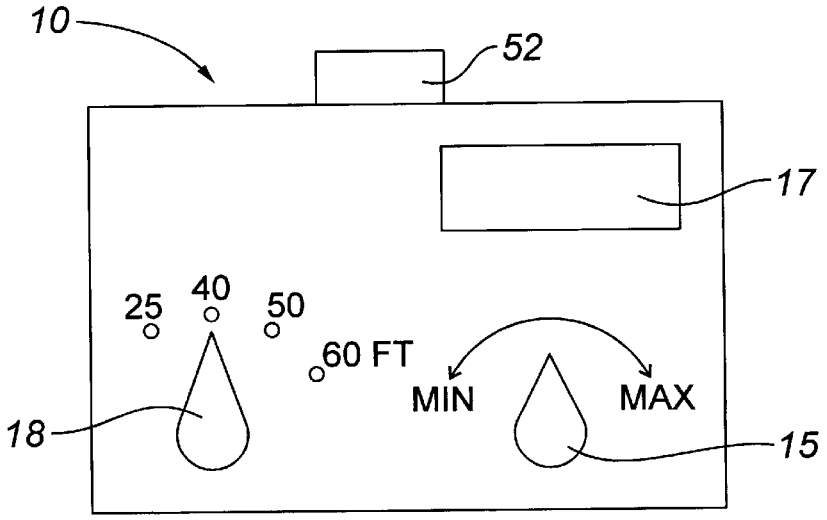
FIG. 2

APPARATUS FOR DETERMINING A SPEED OF A PROJECTILE

FIELD OF THE INVENTION

The present invention relates to an apparatus for determining a speed of a projectile and, in particular, a hockey puck.

BACKGROUND OF THE INVENTION

It is common for booths to be set up at athletic venues and athletes invited to pay a fee to demonstrate their athletic prowess in an objective manner. One objective measurement of athletic prowess relates to the speed of a projectile. For baseball players, the speed of a pitch is measured. For hockey players, the speed of a shot is measured.

These booths generally have a target at which the projectile is directed. A variety of technologies are used to determine the speed of the projectile. The most commonly used technology is a radar gun, similar to that used by traffic policemen to catch speeders. Although other technologies are used that place sensors on the target and measure the speed of the projectile at impact. U.S. Pat. No. 5,447,315 which issued to Perkins in 1995 is an example of the latter category of technology. The Perkins reference uses a target which has acoustic sensors. The impact of a projectile against the target creates an acoustic shock wave that is analyzed to determine the speed of the projectile at the time of impact.

U.S. Pat. No. 3,643,959 which issued to Cornell et al in 1972 discloses a Golf Game in which the velocity of a projectile is measured as part of a greater calculation as to the distance a golf shot would have travelled had it not hit the target. The Cornell et al reference uses two microphones; a first microphone positioned at a golf tee and a second microphone positioned at a target. The first microphone at the tee is used to pick up the sound of a golf club encountering a ball. A first acoustic signal from the first microphone triggers a first switch which initiates the charging of a capacitor. The capacitor is tied to a meter, such that the output on the capacitor is reflected by the reading on the meter. The second microphone is positioned at the target to pick up the sound of the ball hitting the target. The second microphone is connected to a second switch which terminates the changing of the capacitor. The charge on the capacitor is related to the time the ball took to get to the target, which enables a calculation as to the distance the ball to would have travelled had it not hit the target.

It would be an advantage for an athlete to be able to test himself on a regular basis in order to objectively gauge his or her progress. However, these installations are too complex and, consequently, too expensive for the average athlete.

SUMMARY OF THE INVENTION

What is required is an apparatus for determining a speed of a projectile which is simple enough and, consequently, inexpensive enough for the average athlete to afford.

According to the present invention there is provided an apparatus for determining a speed of a projectile including control logic means and a single acoustic sensor connected to the control logic means. The control logic means includes a pulsing clock. The control logic means starting the clock upon receiving a first signal from the acoustic sensor and stopping the clock upon receiving a second signal from the acoustic sensor. The control logic means includes means for converting pulses of the clock into a numeric value indicative of speed based upon a preprogrammed distance measurement setting. Output means for communicating the speed measurement to a user.

The apparatus for determining a speed of a projectile, as described above, determines the speed of the projectile from the pulses of the clock. This can be done in a number of ways, one of the easiest and most cost effective is to provide at least one counter which is driven by pulses from the clock. When the clock is stopped by the second acoustic signal, the counter will reflect a numeric value. This numeric value is indicative of relative speed. The lower the numeric value, the faster the shot travelled. An apparatus that used only a counter would be the simplest and least expensive type of device. The public, however, would prefer to see the speed of their shot reflected in the more traditional speed measurements of miles per hour or kilometers per hour. For that reason, it is preferred that the control logic means include means for converting a numeric value derived from the at least one counter into a speed measurement in miles per hour or kilometers per hour.

The apparatus, as described above, is ideal for determining the speed of a hockey slap shot. A blade of a hockey stick striking a puck makes a noise that is picked up by the acoustic sensor as the first acoustic signal. The puck striking the boards of the hockey rink makes a noise that is picked up by the acoustic sensor as the second acoustic signal. The apparatus can be sold with instructions to shoot from a set distance, such as 25 feet, and the apparatus preprogrammed to perform speed calculations based upon an assumption that the hockey puck has travelled 25 feet during the time interval between the first acoustic signal and the second acoustic signal. The apparatus, as described above, will admittedly give erroneous readings periodically when a background noise prematurely triggers the second acoustic signal. However, for the intended application such periodic errors will be insignificant and not detract from the overall utility of the apparatus. It will be apparent to one skilled in that art that there are a number of alternative output devices that can be used to communicate the speed measurement to the user. A printer is not considered very practical. An acoustic voice module is considered cost prohibitive. The most practical output means is likely one of the various visual display technologies.

With the sport of baseball, there is no noise generated when the ball leaves the pitchers hand. The teachings of the present invention can, however, be readily adapted to baseball or other sports by adding to the apparatus means for making a noise concurrently with an initiation of a flight of a projectile. There are a variety of noise making devices that can be purchased, which can be triggered by the baseball pitcher with his or her free hand.

Although beneficial results may be obtained through the use of the apparatus, as described above, a preset distance can be limiting. Hockey players would likely prefer to try their skill at a variety of distances. Even more beneficial results may, therefore, be obtained when means is provided for changing the preprogrammed distance measurement setting. The most convenient and cost effective manner of accomplishing this objective is to provide a plurality of preprogrammed distance measurement settings. Some means, such as a selector dial, can be provided for selecting one of the plurality of preprogrammed distance measurement settings.

BRIEF DESCRIPTION OF THE DRAWINGS

These and other features of the invention will become more apparent from the following description in which reference is made to the appended drawings, wherein:

FIG. 1 is a simplified block diagram of an apparatus for determining a speed of a projectile constructed in accordance with the teachings of the present invention.

FIG. 2 is a top plan view of the apparatus illustrated in FIG. 1.

DETAILED DESCRIPTION OF THE PREFERRED EMBODIMENT

Figure 3A:
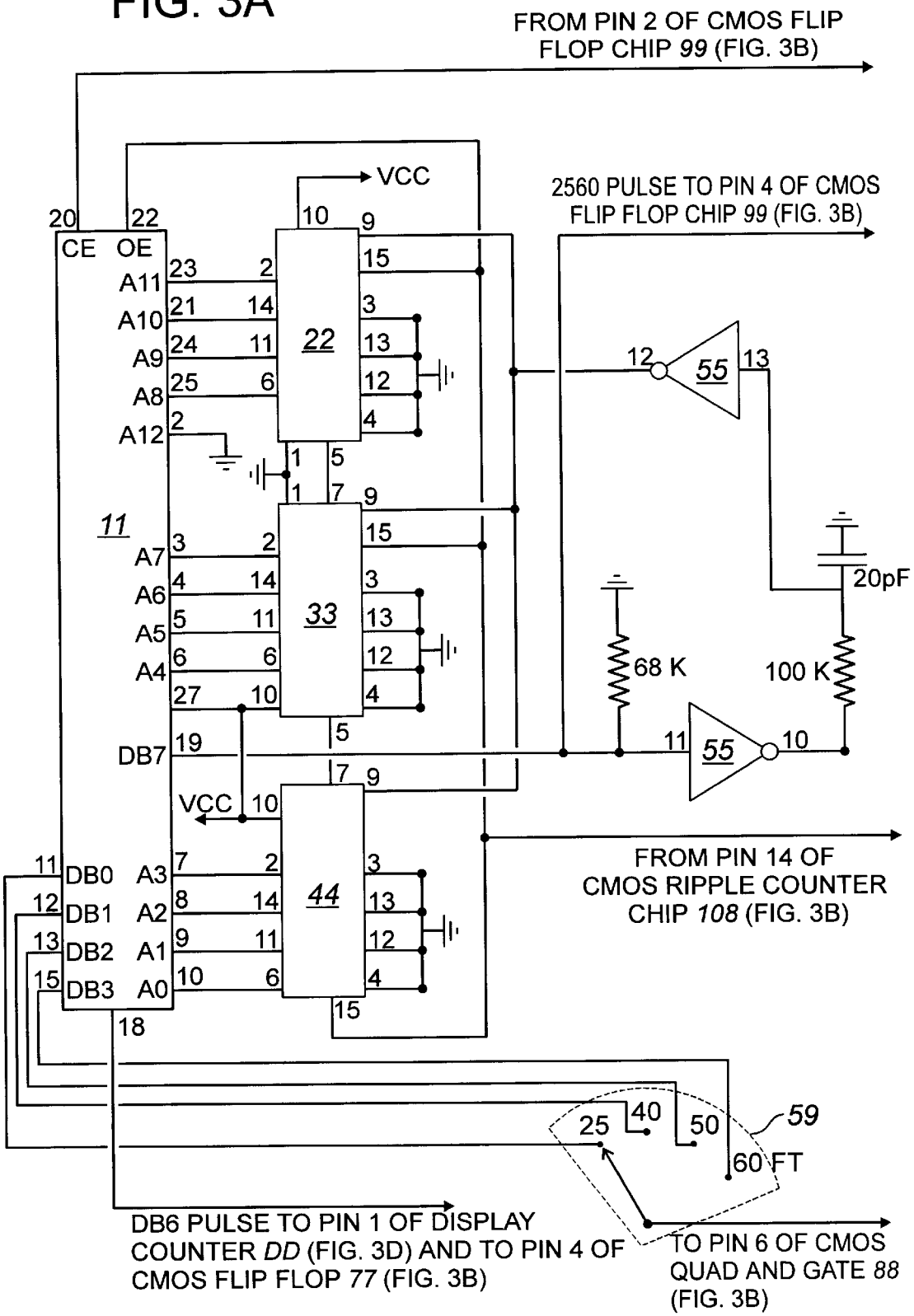
FIGS. 3*a* and 3*b* are collectively a detailed circuit diagram of a control logic portion of the apparatus illustrated in FIG. 1.
Figure 3B:
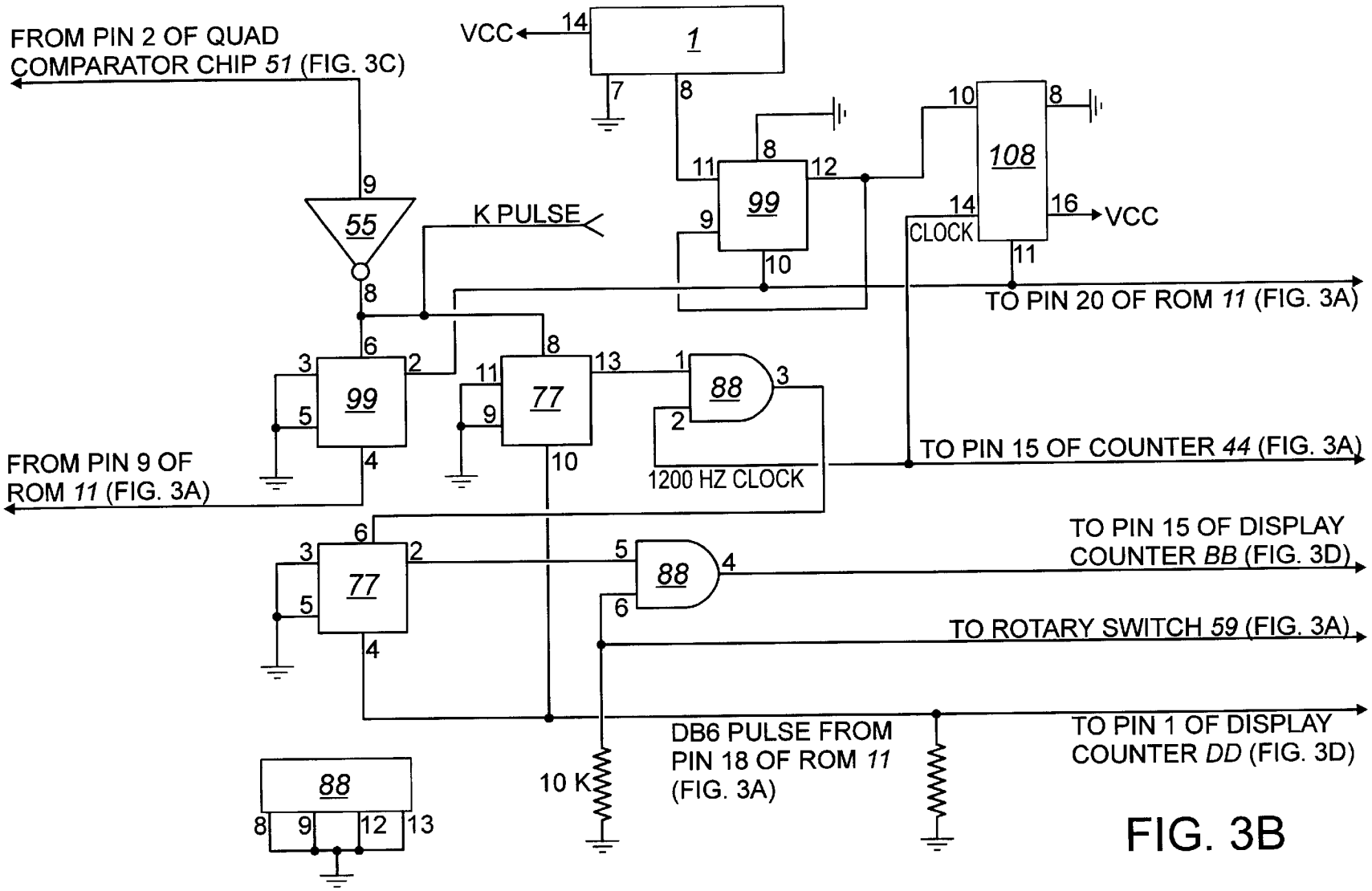

The preferred embodiment, an apparatus for determining a speed of a projectile generally identified by reference numeral 10, will now be described with reference to FIGS. 1 through 4. Apparatus 10, as illustrated was constructed out of commercially available components using control logic in order to demonstrate the viability of the invention. A BASIC program was developed to generate the ROM data. Although apparatus 10 will hereinafter be described with reference to the game of hockey, it will be appreciated that apparatus 10 could be adapted for use in other sports.

The building blocks of apparatus 10 are illustrated in FIG. 1. Apparatus 10 has an analog section, hereinafter further described with reference to FIG. 3*c*, which includes an acoustic sensor/microphone 52, a variable amplifier 50 and an analog to digital converter 51. Apparatus 10 has a digital control logic section, hereinafter further described with reference to FIGS. 3*a* and 3*b*, which includes control logic generally identified by reference numeral 12 (including components 55, 68, 77, 88, 99, and crystal clock 108 as hereinafter described), counters 22, 33, 44 and ROM 11. Finally, apparatus 10 has a display and power section, hereinafter further described with reference to FIGS. 3*d* and 3*e*, which includes display counters bb, cc, dd, and an LCD display 17.

Referring to FIG. 2, apparatus 10 is positioned in a housing 13. Mounted onto housing 13 is microphone 52. A first selector dial 15 is provided to provide manual control of amplification through variable amplifier 50. A second selector dial 18 is provided for selecting from one of a plurality of preprogrammed distance measurement settings. LCD display 17 is visibly mounted to housing 13 to display the speed measurement to a user.

Figure 4:
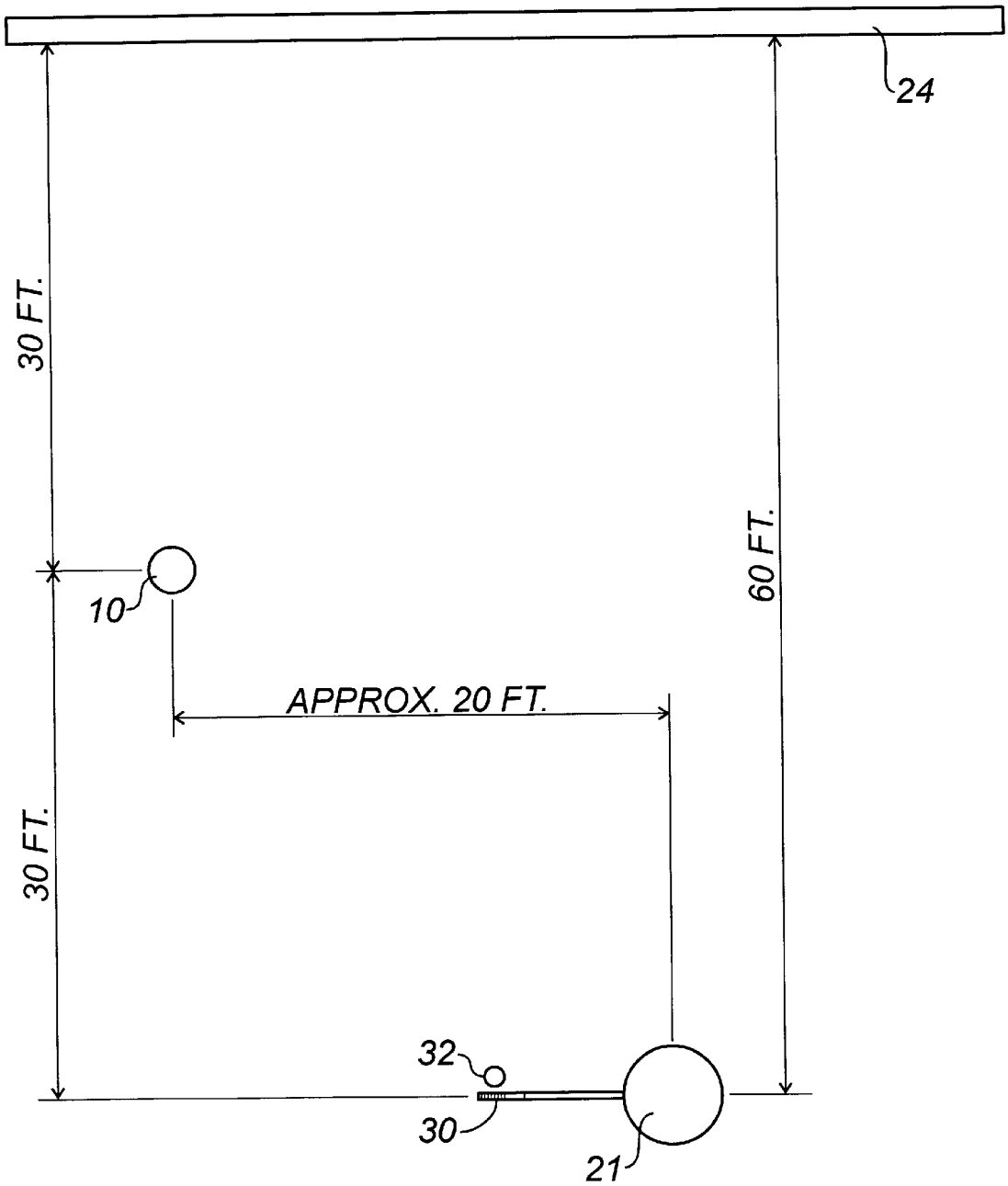
FIG. 4 is a diagrammatic view showing the positioning of the apparatus illustrated in FIG. 1 during use.

The use and operation of apparatus 10 will now be described with reference to FIGS. 1, 2, and 4. Referring to FIG. 4, there is illustrated a hockey player 21 and target boards 24. These target boards are, typically, the boards that encircle an ice surface of a hockey rink. Hockey player 21 sets apparatus 10 equidistant between himself and boards 24. In FIG. 4, the distance is 60 feet, with apparatus 10 being laterally placed 20 feet away from the intended shooting line and 30 feet away from both target boards 24 and hockey player 21. Selector dial 18 is then set for the selected shooting distance of 60. Hockey player 21 then uses his hockey stick 30 to shoot a puck 32 at boards 24 using a slap shot technique. As will hereinafter further be described control logic 12 is initiated by a first acoustic signal. The noise generated by the contact between hockey stick 30 and puck 32 is picked up by microphone 52. This first acoustic signal initiates control logic 12 which includes clock 108. Control logic 12 is concluded with a display as to the speed of puck 32 by a second acoustic signal. The noise generated by puck 32 hitting boards 24 is picked up by microphone 52 initiating the second acoustic signal. The control logic 12 includes Rom 11 and counters 22, 33, 44, which serve as means for performing calculations which convert a time interval between the first acoustic signal and the second acoustic signal, as registered by clock 108, into a speed measurement based upon the preprogrammed distance measurement setting of 60 feet. The speed measurement can also be provided in kilometers, if desired. Referring to FIG. 2, the speed measurement is displayed on LCD display 17. If background noises are resulting in false readings, the sensitivity of apparatus 10 to background noise can be adjusted by means of selector dial 15 that controls variable amplifier 50.

Figure 3C:
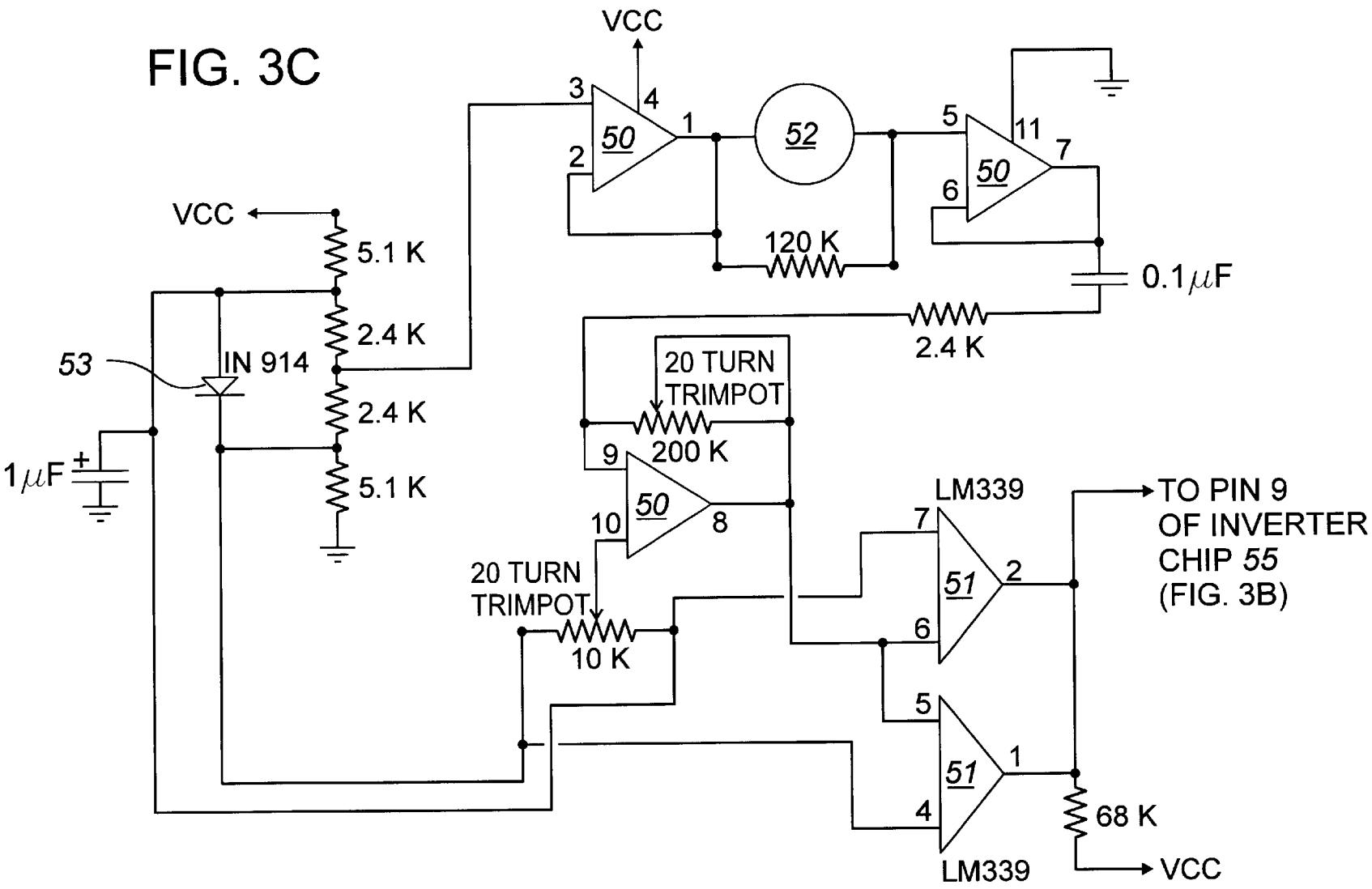
FIG. 3*c* is a detailed circuit diagram of the analog section of the apparatus illustrated in FIG. 1, including a microphone, an amplifier and an analog to digital converter.

Referring to FIG. 3*c*, the components associated with the analog portion of apparatus 10, include QUAD OP AMP MC4741 chip 50, QUAD COMPARATOR LM339 chip 51, crystal microphone 52 and a diode 53. Chip 50 is a Quad Operational Amplifier sold by Motorola Semiconductor as MC4741. Chip 51 is a Quad Comparator sold by Motorola Semiconductor as LM339. Diode 53 is used to generate voltage reference for quad comparator chip 51. In operation, crystal microphone 52 acquires the signal which is amplified at pin 8 of chip 50 and delivered to quad comparator chip 51 at pins 5 and 6. Pins 1 and 2 of 339 quad comparator chip 51 are output active when the signal exceeds threshold voltages. Quad comparator chip 51 serves as an analog to digital converter, producing a digital signal. This digital active low signal is fed to the control logic.

The components associated with the control logic includes an oscillator 1, a Rom 11, inverter chip 55, flip flop chip 77, Cmos ripple counter chip 108, flip flop chip 99, chip 88 and counters 22, 33, and 44. Oscillator 1 is a 2.4576 MHZ Integrated crystal oscillator sold by Fox. Rom 11 is an EEROM microchip sold by Microchip Technologies Inc. as 28C64A. Chip 55 is a Hex Cmos Schmitt Trigger (Inverter) sold by National Semiconductor as CD4584. Clock 108 is a Cmos Ripple counter sold by National Semiconductor as CD4020, which is used in this application as a crystal controlled clock. Chips 77 and 99 are Cmos Flip Flops sold by National Semiconductor as CD4013. Chip 88 is a CMOS Quad And Gate sold by National Semiconductor as CD4081. Counters 22, 33, and 44 are Binary 4 Bit up Down Cmos Counters sold by National Semiconductor as CD4516. The digital active low signal is fed into pin 9 of chip 55 and inverted. At this point it is referred to as the "K" pulse. The K pulse sets pin 2 of chip 99 which starts crystal controlled clock 108 and counters 22, 33, and 44. Counters 22, 33, and 44 begin to count up. They are clocked by crystal controlled clock 108 through pin 14 1200 HZ. At the same time as the K pulse is setting pin 2 of chip 99 to starts crystal controlled clock 108, it is also electrically enabling erasable ROM 11. The output of counters 22, 33, and 44 drive ROM A0 to A11. Since only the bottom half of ROM 11 is being used, A12 of ROM 11 is tied to VCC. ROM data is generated by a BASIC program, which is hereinafter set forth. The BASIC program converts the counter addresses of counters 22, 33, and 44 to speed. The program is based upon the premise that speed decreases with elapsed time. In other words, the longer it takes the projectile to arrive at boards 24, the slower it must be going. Every time the counters reach an output address that corresponds to a change in speed, the EERom 11 outputs a data one bit at the selected distance output. These data bits are used to clock down the display counters to the appropriate speed, which is continuously displayed until the next shot.

Each output DB0, DB1, DB2, and DB3 corresponds to a distance. When selector dial 18 is moved rotary switch 59 selecting one of DB lines (DB0 to DB3), depending upon the desired distance from which hockey player 21 desires to make his shot. The selections are DB0 at 25 feet, DB1 at 40 feet, DB2 at 50 feet or DB3 at 60 feet. Assume that DB0 has been selected indicating a distance of 25 feet. This is the distance from hockey player 21 to boards 24. Using the formula that SPEED equals DISTANCE divided by TIME, where SPEED is in miles per hour, DISTANCE is in miles, and TIME is in hours; the BASIC program computes and prints out the following data:

| | | | | | |
|---|---|---|---|---|---|
| 11 | 1 1 1 1 | 1860 | 2975 | 3719 | 4463 |

This example is for address 11. The 1 1 1 1 are the data bits for DB0, DB1, DB2, and DB3, respectively. The 1860, 2975, 3719, and 4463 are the speed in miles per hour for DB0, DB1, DB2, and DB3, respectively.

Figure 3D:
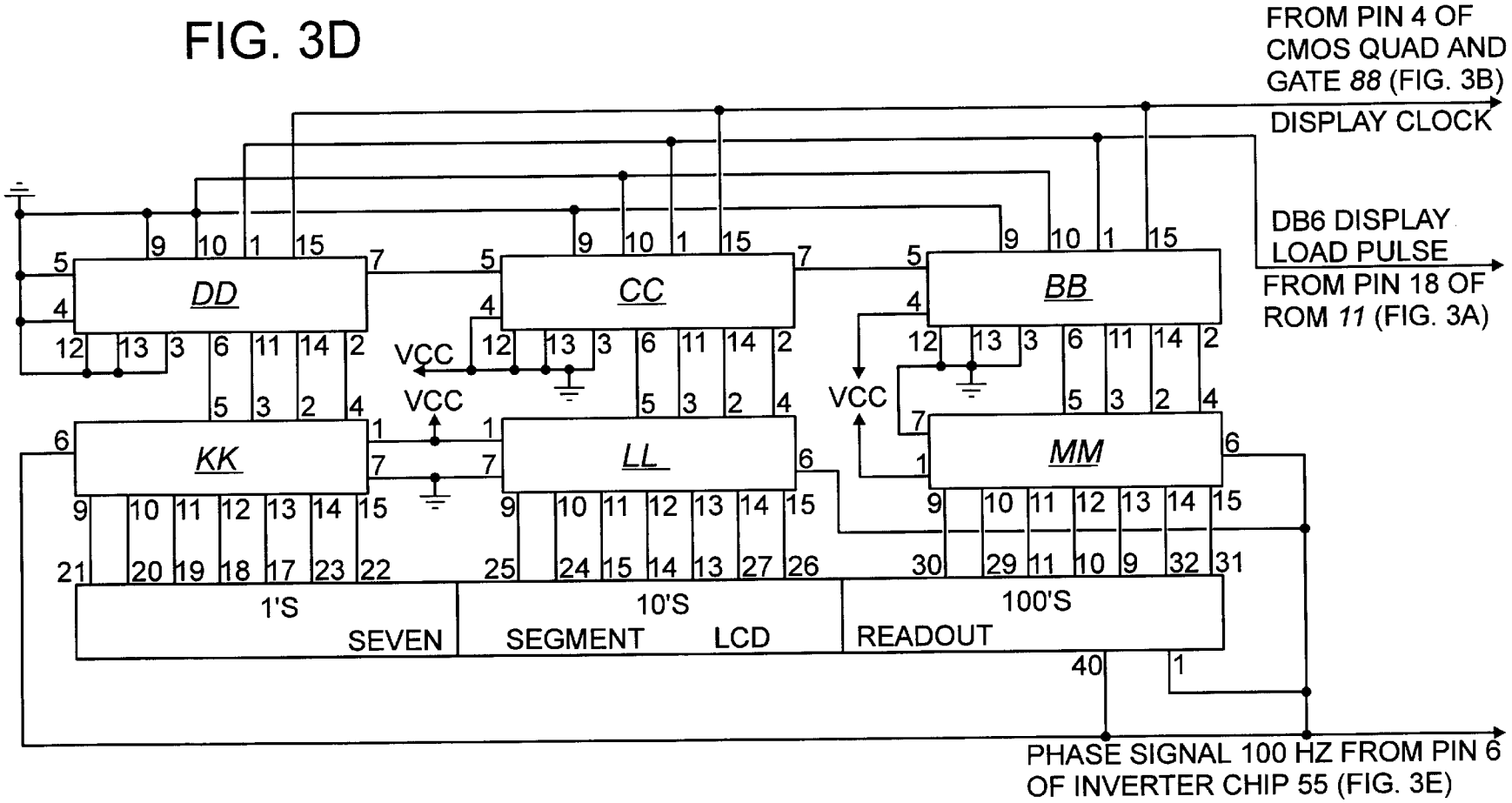
FIGS. 3*d* and 3*e* are collectively a detailed circuit diagram of the display output and power supply of the apparatus illustrated in FIG. 1.
Figure 3E:
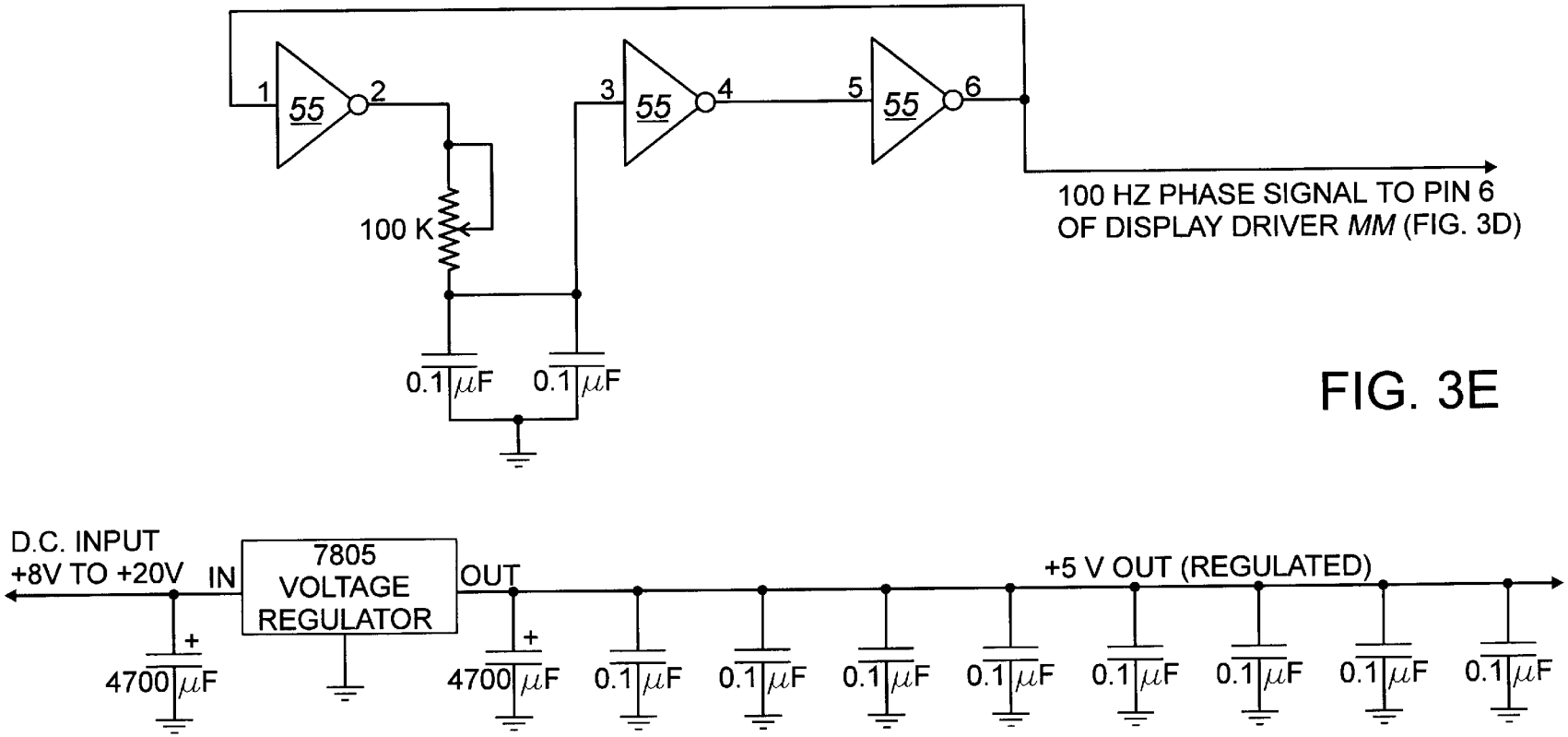

Referring to FIGS. 3*d* and 3*e*, the components associated with the display section include a plurality of display counters BB, CC, and DD, an LCD display 17, and display drivers kk, ll, mm. Display counters BB, CC, and DD are Cmos BCD Counters sold by National Semiconductor as CD4510. Display drivers kk, ll, mm are CMOS decoder and seven segment drivers sold by National Semiconductor as CD4543. Power to apparatus 10 is supplied through a 5 volt voltage regulator manufactured by motorola semiconductor as 7805. Display counters BB, CC, and DD are used to translate the data bits into a recognizable reading in miles per hour. At the first address location speed equals 130 miles per hour, in this case the first address is DB0 address 157 A 1. This address is loaded as data bit 1 into DB6 data line. All other locations on the DB6 data line are loaded 0. This one bit is used to load count 130 in the display counters BB, CC, and DD. All bits up to and including address 157 are loaded with 0. After that all DB0 bits are as per the BASIC program. The BASIC program only shows addresses where there is at least one bit (DB0 to DB3) which equals 1. All other locations are zeros. All addresses DB1 up to and including address 251 are zeros. The same applies to DB2 up to and including address 314 and DB3 up to and including address 377. All other location are loaded as per the BASIC printout. The only other pertinent information about the ROM data is the 2560 pulse. At address 2560 A 1 is loaded into DB7 line. All other DB7 locations are zeros. The ROM data pulses initiate concurrent display clock pulses counting down from 130 miles per hour. 130 miles per hour is selected as it represents a value that is faster than professional hockey players are capable of shooting a hockey puck. The DB6 pulse enables the display clock pulses at chip 68 pins 10 and 4 through AND GATE 4081 CHIP 88 PIN 4. The next K pulse will disable the display counter clock at PIN 8 of CHIP 77. The display will be held until the next K pulse starts the process over again. The display at this point has counted down from 130 miles per hour to show the speed of the shot in miles per hour. Counters 44, 33, and 22 continue to count until address 2560 at which time the 2560 pulse resets the counters and flop 99 pin 2, which shuts down the clock 108 and the ROM. The cycle is then ready to be repeated. With this configuration, there must be at least 2 and ½ seconds between shots.

Referring to FIG. 4, when using apparatus 10, the best results are obtained when apparatus 10 is positioned an equal distance from hockey player 21 and boards 24. This cancels any error that my arise due to the speed of sound. For example, if apparatus 10 were set up beside hockey player 21 and 60 feet from boards 24, the speed displayed would be a few miles per hour slower than its actual speed. This type of error can be avoided by placing apparatus 10, about 10 or 15 feet to the side of a straight line between hockey player 22 and boards 24 and equidistant to hockey player 21 and boards 24. An alternative approach to this problem would be to modify ROM data. For example if apparatus 10 were 3 feet from hockey player 21 and 60 feet from boards 24, the an allowance would have to be made in the calculations to take into account the speed it takes for sound to travel 57 feet. This time could be calculated and divided by the length of a clock pulse (1/1200 of a second). This number could be rounded off and added to the addresses in the ROM data. This has the effect of delaying the display clock count down long enough to compensate for the speed of sound.

Apparatus 10 could be adapted for use in other sports, such as baseball. The baseball pitcher would have to throw the ball at an object that would generate a noise upon impact with the ball. DB5 and DB4 of the illustrated embodiment are unused data lines and could readily be used for a distance appropriate for baseball. A problem which would have to be addressed is how to trigger apparatus 10 when the baseball pitcher released the ball. A simple solution is to have the pitcher initiate a noise with some form of noise making device. However, more elaborate mechanisms could also be employed. For example, an opto or mechanical device in the form of a microswitch could be used that would trigger when the pitcher extends his arm in the throwing motion. This unit could be a microswitch strapped to the pitcher's back and triggered by a small diameter elastic rope tied to the pitcher's wrist. The small diameter elastic rope would not provide enough tension to adversely affect the throw, but would provide enough tension to trigger the switch. The switch could trigger a noise generating device or could be wired to send a signal to the control logic. A noise generating device, as described, would preferably be one of high amplitude, battery operated, and small enough to be strapped onto the pitcher.

A simple BASIC program that operates apparatus 10, as illustrated, is as follows:

```
  1 LET a = 1/1200
  2 LET b = 10
  3 LET c = 25/5280/(a/3600 * 10)
  4 LET d = c
  5 LET e = 40/5280/(a/3600 * 10)
  6 LET f = e
  7 LET y = 50/5280/(a/3600 * 10)
  8 LET z = y
  9 LET t = 60/5280/(a/3600 * 10)
 10 LET u = t
 19 LPRINT 0, 0; 0; 0; 0
 20 LPRINT "_"
 30 FOR n = 1 TO 4095
 32 LET b = b + 1
 40 FOR x = 1 TO 4
 50 IF x = 1 THEN GOSUB 200
 60 IF x = 2 THEN GOSUB 300
 65 IF x = 3 THEN GOSUB 400
 70 IF x = 4 THEN GOSUB 500
 75 NEXT x
 80 LET w = j + k + l + m
 90 IF w > 0 THEN LPRINT b, j; k; l; m, c; e; y; t
100 IF w > 0 THEN LPRINT
```

-continued

```
" "
110 NEXT n
120 GOTO 610
200 LET g = 25
216 IF n = 1 THEN LET p = (1/1200) * 10
220 LET p = p + (1/1200)
240 LET d = c
250 LET c = g/5280/(p/3600)
260 LET c = CINT(c)
270 LET j = 1
280 IF c = d THEN LET j = 0
290 LET d = c
295 RETURN
300 LET g = 40
310 IF n = 1 THEN LET q = (1/1200) * 10
320 LET q = q + (1/1200)
340 LET f = e
350 LET e = g/5280/(q/3600)
360 LET e = CINT(e)
370 LET k = 1
380 IF e = f THEN LET k = 0
390 LET f = e
395 RETURN
400 LET g = 50
410 IF n = 1 THEN LET r = (1/1200) * 10
420 LET r = r + (1/1200)
440 LET z = y
450 LET y = g/5280/(r/3600)
460 LET y = CINT(y)
470 LET 1 = 1
480 IF y = z THEN LET 1 = 0
490 LET z = y
495 RETURN
500 LET g = 60
510 IF n = 1 THEN LET s = (1/1200) * 10
520 LET s = s + (1/1200)
540 LET u = t
550 LET t = g/5280/(s/3600)
560 LET t = CINT(t)
570 LET m = 1
580 IF t = u THEN LET m = 0
590 LET u = t
600 RETURN
610 END
```

It will be apparent to one skilled in the art that apparatus 10 is considerably smaller than apparatus for measuring the speed known in the prior art. Housing 13 for apparatus 10 is a small box that can be placed in laterally adjacent the shooting area, as described in relation to FIG. 4. The operation of the device is exceedingly simple, so that it can be operated by young athletes in the nine to fourteen years old range. There is no need for a special target, any surface that is hard enough to make a noise when struck is sufficient. It will be apparent to one skilled in the art that it is possible to manufacture either simplified versions or enhanced versions of apparatus 10. A possible simplified version would involve coupling the counters directly to the visual display. The visual display would display the numeric value of the counters as an indication of speed. That part of the device that converts the numeric value of the counter into miles per hour or kilometers per hour would be eliminated. An enhanced version of apparatus 10 would use a microprocessor to provide greater computer power. Although this would increase the cost and complexity of apparatus 10, it would allow the apparatus to be adapted to work at any distance and speed. The use of a parabolic microphone would allow use of apparatus 10 at greater distances. It will be apparent to one skilled in the art that modifications may be made to the illustrated embodiment without departing from the spirit and scope of the invention as hereinafter defined in the claims. In particular, it will be apparent to one skilled in that art that in a commercial version of apparatus 10, it may be possible to reduce the number of components by using some specially designed components that are capable of performing more than one function.

The embodiments of the invention in which an exclusive property or privilege is claimed are defined as follows:

1. An apparatus for determining a speed of a projectile, comprising:

control logic means including a pulsing clock, means for starting and stopping the clock and means for converting pulses of the clock into a numeric value indicative of speed based upon a preprogrammed distance measurement setting;

a single acoustic sensor connected to the control logic means;

the control logic means starting the clock upon receiving a first signal from the acoustic sensor, the control logic means stopping the clock upon receiving a second signal from the acoustic sensor;

the control logic means converting pulses of the clock into a numeric value indicative of speed based upon the preprogrammed distance measurement setting; and output means for communicating the speed measurement to a user.

2. The apparatus for determining a speed of a projectile as defined in claim 1, wherein the means for converting pulses of the clock into a numeric value indicative of speed includes at least one counter driven by pulses from the clock.

3. The apparatus for determining a speed of a projectile as defined in claim 2, wherein the control logic means includes means for converting a numeric value derived from the at least one counter into a speed measurement in one of miles per hour and kilometers per hour.

4. The apparatus for determining a speed of a projectile as defined in claim 1, wherein the output means is a visual display.

5. The apparatus for determining a speed of a projectile as defined in claim 1, wherein means is provided for changing the preprogrammed distance measurement setting.

6. The apparatus for determining a speed of a projectile as defined in claim 1, wherein a plurality of preprogrammed distance measurement settings are provided and means is provided for selecting one of the plurality of preprogrammed distance measurement settings.

7. The apparatus as defined in claim 1, wherein means is provided for making a noise concurrently with an initiation of a flight of a projectile.

8. An apparatus for determining a speed of a projectile, comprising:

control logic means including a pulsing clock, means for starting and stopping the clock, at least one counter driven by pulses from the clock and a ROM;

an acoustic sensor including a single microphone connected via a variable amplifier and an analog to digital converter to the control logic means;

the control logic means starting the clock upon receiving a first signal from the acoustic sensor, the control logic means stopping the clock upon receiving a second signal from the acoustic sensor;

display counters connected via display drivers to a visual display; and as the at least one counter reaches an output address that corresponds to a change in speed from a preprogrammed distance measurement setting, the ROM outputs a data bit to clock down the display counters, thereby converting the counter value into a speed measurement displayed by the display drivers on the visual display.

9. The apparatus for determining a speed of a projectile as defined in claim 1, wherein a plurality of preprogrammed distance measurement settings are provided and means is provided for selecting one of the plurality of preprogrammed distance measurement settings.

10. An apparatus for determining a speed of a projectile, comprising:

control logic means including a pulsing clock, means for starting and stopping the clock and means for converting pulses of the clock into a numeric value indicative of speed based upon a preprogrammed distance measurement setting;

signal means for signaling to the control logic means an initiation of a flight of a projectile;

a single acoustic sensor connected to the control logic means;

the control logic means starting the clock upon receiving a first signal from the signal means, the control logic means stopping the clock upon receiving a second signal from the acoustic sensor;

the control logic means converting pulses of the clock into a numeric value indicative of speed based upon the preprogrammed distance measurement setting; and output means for communicating the speed measurement to a user.

* * * * *